US008075290B2

(12) United States Patent
Ginies et al.

(10) Patent No.: US 8,075,290 B2
(45) Date of Patent: Dec. 13, 2011

(54) SCROLL COMPRESSOR WITH VALVE FOR CONTROLLING FLUID TO FLOW FROM AN OUTER WALL TO AN INNER WALL OF A FIXED OR A MOVABLE SPIRAL WRAP

(75) Inventors: Pierre Ginies, Sathonay (FR); Christophe Ancel, Villefranche sur Saone (FR); Dominique Gross, Jassans Riottier (FR)

(73) Assignee: Danfoss Commerical Compressors, Trevoux (FR)

( * ) Notice: Subject to any disclaimer, the term of this patent is extended or adjusted under 35 U.S.C. 154(b) by 427 days.

(21) Appl. No.: 12/379,356

(22) Filed: Feb. 19, 2009

(65) Prior Publication Data

US 2009/0208356 A1 Aug. 20, 2009

(30) Foreign Application Priority Data

Feb. 19, 2008 (FR) ..... 08 00874

(51) Int. Cl.
*F03C 2/00* (2006.01)
*F03C 4/00* (2006.01)
*F04C 2/00* (2006.01)

(52) U.S. Cl. ..... 418/55.2; 418/55.5; 418/57; 418/270; 417/310; 417/440

(58) Field of Classification Search ..... 418/55.1–55.6, 418/57, 270, 15; 417/299, 310, 440
See application file for complete search history.

(56) References Cited

U.S. PATENT DOCUMENTS

| | | | | |
|---|---|---|---|---|
| 4,457,674 | A * | 7/1984 | Kawano et al. | 418/55.2 |
| 4,477,238 | A * | 10/1984 | Terauchi | 418/55.2 |
| 6,273,691 | B1 * | 8/2001 | Morimoto et al. | 418/15 |
| 6,746,224 | B2 * | 6/2004 | Itoh et al. | 418/55.2 |
| 6,764,288 | B1 | 7/2004 | Liepert et al. | |
| 7,344,365 | B2 * | 3/2008 | Takeuchi et al. | 418/55.2 |
| 2005/0053507 | A1 * | 3/2005 | Takeuchi et al. | 418/55.2 |
| 2006/0269432 | A1 | 11/2006 | Lifson | |

FOREIGN PATENT DOCUMENTS

| | | | |
|---|---|---|---|
| EP | 0 913 581 | A1 | 5/1999 |
| EP | 1 790 856 | A1 | 5/2007 |
| JP | 62182486 | A * | 8/1987 |
| JP | 03-018679 | A | 1/1991 |
| JP | 03124982 | A * | 5/1991 |
| JP | 07-077178 | A | 3/1995 |
| JP | 07-293459 | A | 11/1995 |
| JP | 2002-070769 | A | 3/2002 |
| JP | 2002-195174 | | 7/2002 |

* cited by examiner

*Primary Examiner* — Theresa Trieu
(74) *Attorney, Agent, or Firm* — Oliff & Berridge, PLC

(57) ABSTRACT

Compressor has a fixed scroll and a scroll movable in an orbit relative to the fixed scroll. The fixed and movable scrolls are equipped with a spiral wrap that engage each other and delimit variable-volume compression chambers. The spiral wrap of the movable scroll has a stepped portion extending over at least a portion of its length. At least one of the scrolls defines a passage for communication, during orbital movement of the movable scroll, between two compression chambers, with the ends of the passage terminating respectively on either side of the outer and inner walls of the spiral wrap of the scroll with the passage or inside the outer and inner walls of the spiral wrap of the scroll with the passage. The passage has a check valve for allowing fluid to flow only from the outer wall of the spiral wrap of the scroll with the passage to the inner wall.

9 Claims, 11 Drawing Sheets

SCROLL COMPRESSOR WITH VALVE FOR CONTROLLING FLUID TO FLOW FROM AN OUTER WALL TO AN INNER WALL OF A FIXED OR A MOVABLE SPIRAL WRAP

BACKGROUND

The present invention relates to a scroll-type refrigeration compressor.

U.S. Pat. No. 4,477,238 describes a scroll-type refrigeration compressor comprising an impermeable housing delimited by an envelope and containing a fixed scroll and a movable scroll, whereby the movable scroll describes an orbital movement relative to the fixed scroll, the fixed and movable scrolls each being equipped with a spiral wrap, the two spiral wraps being engaged with each other and delimiting at least two variable-volume compression chambers.

According to a first embodiment described in U.S. Pat. No. 4,477,238, each spiral wrap has a stepped portion extending over at least a portion of its length starting from its outer end.

This results in the volume of the two external compression chambers, and hence the displacement of the compressor, being increased. These features thus enable compressor performance to be enhanced.

However, this embodiment requires provision of a recess in the plate of the movable scroll designed to receive the stepped portion of the spiral wrap of the fixed scroll.

In order not to decrease the mechanical strength of the plate due to creation of this recess, it is necessary to increase the thickness of the plate. This thickness increase of the plate increases the weight of the movable scroll and hence its inertia. This increase in inertia translates directly into an increased mechanical load on the hub of the movable scroll and the bearings of the movable scroll drive shaft, which can lead to premature wear of the bearings.

According to a second embodiment described in U.S. Pat. No. 4,477,238, only the spiral wrap of the movable scroll has a stepped portion extending over at least a portion of its length from its outer end. These features obviate creation of a recess in the plate of the movable scroll and hence premature wear of the drive bearing of the movable scroll.

However, this embodiment brings about an asymmetrical pressure change between the two outer compression chambers because the volumes of these two chambers are different. The pressure in the chamber which is delimited externally on the wall of the spiral wrap that has the stepped portion is higher than in the chamber which is delimited externally by the wall of the spiral wrap with no stepped portion.

As a result, there are leakages of fluid between these two chambers and hence reduced performance of the compressor.

SUMMARY

The goal of the present invention is to remedy these drawbacks.

The technical problem underlying the invention thus consists of providing a scroll-type refrigeration compressor with a compact design enabling its performance to be enhanced, while avoiding premature damage to certain parts of the compressor.

For this purpose, the invention relates to a scroll-type refrigeration compressor having a fixed scroll and a movable scroll, whereby the movable scroll describes an orbital movement relative to the fixed scroll, the fixed and movable scrolls each being equipped with a spiral wrap, the two spiral wraps engaging each other and delimiting variable-volume compression chambers, only the spiral wrap of the movable scroll having a stepped portion extending over at least a portion of its length, characterized in that at least one of the scrolls has at least one passage designed to provide communication, during orbital movement of the movable scroll, between two compression chambers disposed symmetrically relative to the center of the orbital movement of the movable scroll, with the ends of the passage terminating on either side respectively of the outer and inner walls of the spiral wrap of the scroll with the passage or inside the outer and inner walls of the spiral wrap of the scroll with the passage, and in that the passage has a check valve designed to allow fluid to flow only from the outer wall of the spiral wrap of the scroll with the passage to the inner wall thereof.

The presence of the passage enables the two outer compression chambers to be placed in communication during relative orbital movement of the fixed and movable scrolls, hence balancing the pressures on either side of these two chambers by a flow of fluid from one of the chambers to the other chamber. This pressure balancing thus allows compensation of the pressure dissymmetry between the two outer compression chambers due to creation of a single stepped portion on the spiral wrap of the movable scroll, thus preventing leakages of fluid between the chambers delimited by the spiral wraps.

Only the spiral wrap of the movable scroll has a stepped portion extending over at least a portion of its length. These arrangements obviate creation of a recess in the plate of the movable scroll leading to premature wear of the drive bearing of the movable scroll.

The presence of the check valve in the passage obviates the provision of communication between an inner compression chamber and an outer compression chamber during the orbital movement of the movable scroll, thus avoiding leakage of pressurized fluid into an outer compression chamber when it is at its lowest pressure.

According to one embodiment of the invention, the ends of the passage are offset angularly from each other relative to the center of the orbital movement of the movable scroll by an angle preferably less than or equal to 160°, advantageously less than 120°, and preferably about 60°.

Such angle values limit the length of the passage so that creation of a large dead volume that could diminish compressor performance is avoided and creation of the passage is facilitated.

According to one embodiment of the invention, the fixed scroll has at least one passage disposed facing the portion of the spiral wrap of the movable scroll that has the stepped portion at an angular position relative to the center of the orbital movement of the movable scroll located between the angular position of the inner end of the stepped portion and a point diametrically opposite it.

It should be noted that the center of the orbital movement of the movable scroll is the center of the spiral wrap of the fixed scroll.

Advantageously, the passage provided in the fixed scroll has a check valve designed to allow passage of fluid only from the outer wall of the spiral of the fixed scroll to the inner wall thereof.

Preferably, the end of the passage terminating in or at the inner wall of the spiral wrap of the fixed scroll is recessed from the end of the passage terminating in or at the outer wall of the spiral wrap of the fixed scroll relative to the inner end of the stepped portion.

According to one embodiment of the invention, the stepped portion extends from the outer end of the spiral wrap of the movable scroll.

Advantageously, the stepped portion extends at least 180° from the outer end of the spiral wrap of the movable scroll.

According to another embodiment of the invention, the movable scroll has at least one passage disposed facing its portion that does not have the stepped portion at an angular position relative to the center of the orbital movement of the movable scroll located between the angular position of the inner end of the stepped portion and a point diametrically opposite it.

According to yet another embodiment of the invention, the passage provided in the movable scroll has a check valve designed to allow passage of fluid only from the outer wall of the spiral wrap of the movable scroll to the inner wall thereof.

Preferably, the end of the passage terminating in or at the inner wall of the spiral wrap of the movable scroll is recessed from the end of the passage terminating in or at the outer wall of the spiral wrap of the movable scroll relative to the inner end of the stepped portion.

Advantageously, the fixed and movable scrolls each have several passages offset at an angle, each passage having a check valve.

Preferably, the fixed scroll has a recess designed to receive the stepped portion of the spiral wrap of the movable scroll.

In any event, the invention will be well understood from the description that follows with reference to the attached schematic drawings showing, as non-limiting examples, two embodiments of this scroll-type refrigeration compressor.

DETAILED DESCRIPTION OF EMBODIMENTS

Figure 1:
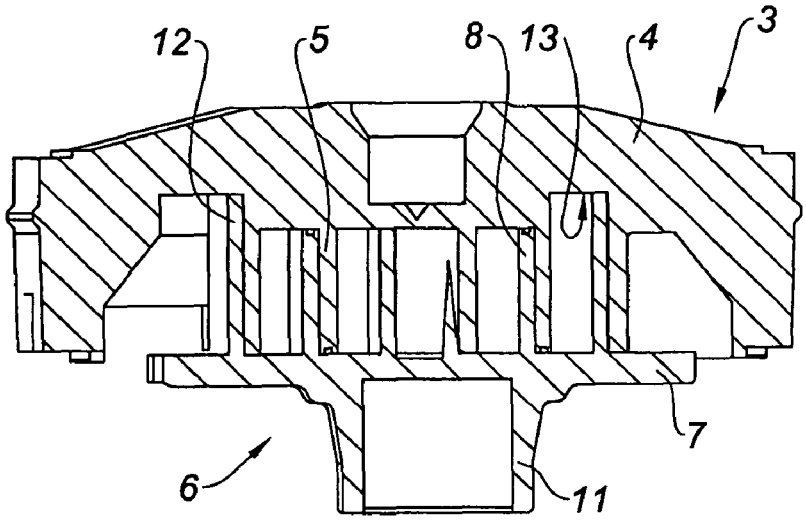
FIG. 1 is a lengthwise sectional view of the fixed and movable scrolls of a scroll-type refrigeration compressor according to a first embodiment.
Figure 2:
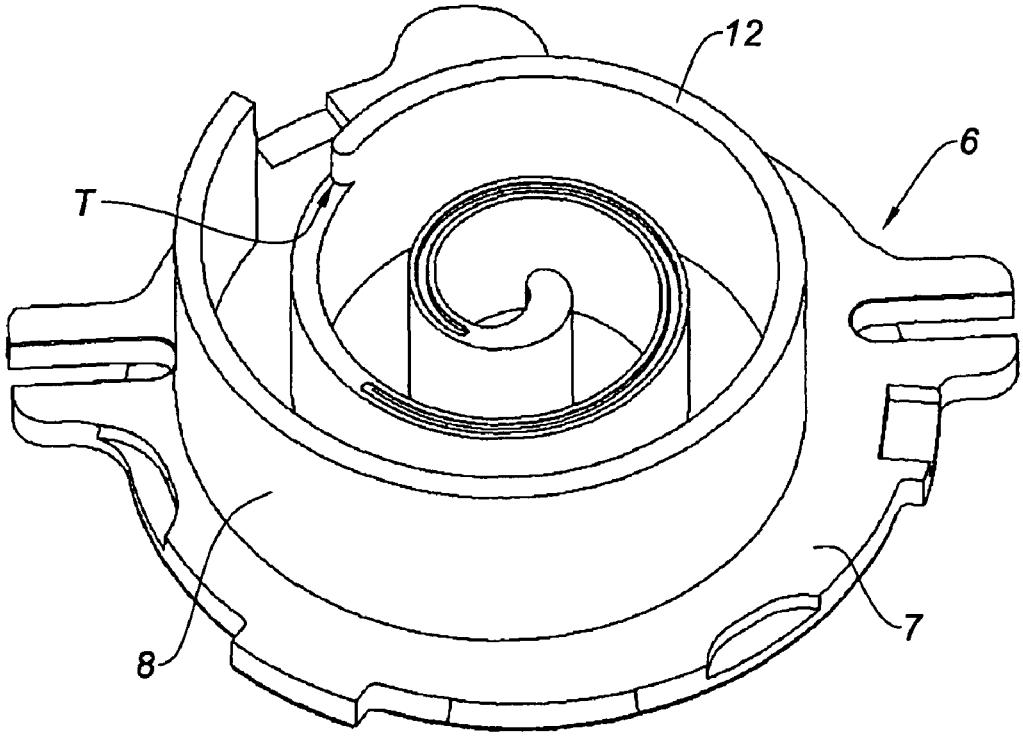
FIG. 2 is a perspective view of the movable scroll of the compressor in FIG. 1.

A scroll-type refrigeration compressor generally has a sealed housing delimited by an envelope containing a body serving for mounting of a coolant-gas compression stage.

This compression stage comprises a fixed scroll 3 having a circular plate 4 equipped with a first spiral wrap 5 facing downward, and a movable scroll 6 having a circular plate 7 equipped with a second spiral wrap 8 facing upward.

The compressor has a drive shaft (not shown in the drawings) whose upper end is engaged in a sleeve-shaped part 11 that comprises the movable scroll 6. When it is driven rotationally by an electrical motor contained in the envelope, the drive shaft drives the movable scroll 6 in an orbital movement relative to the fixed scroll 3.

The first and second spiral wraps 5, 8 are engaged with each other and delimit variable-volume compression chambers.

Figure 3:
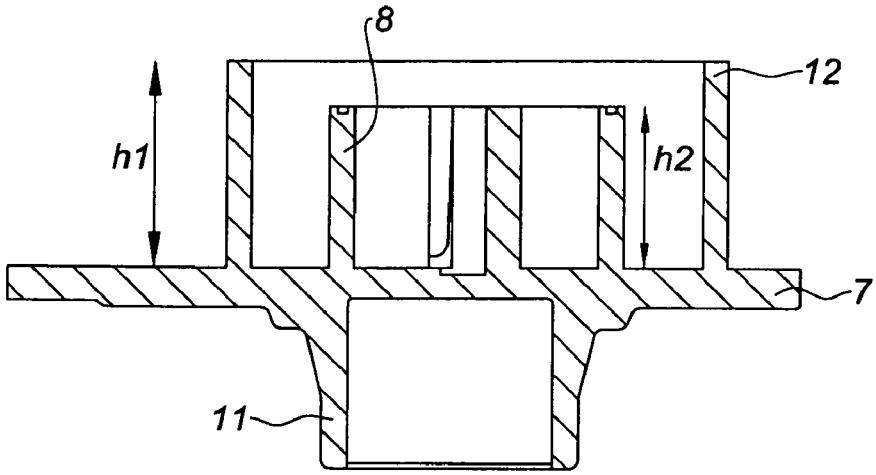
FIG. 3 is a lengthwise sectional view of the scroll in FIG. 2.
Figure 4:
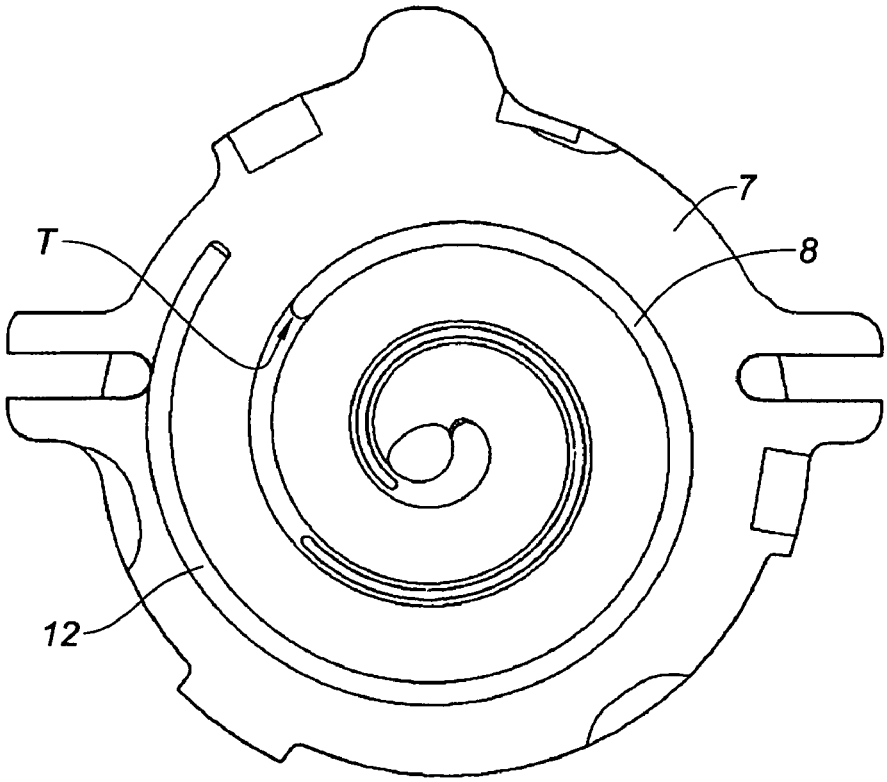
FIG. 4 is a top view of the movable scroll in FIG. 2.

The spiral wrap 8 of the movable scroll 6 has a stepped portion 12 extending over about 360° from its outer end. Thus, the spiral wrap 8 of the movable scroll 6 has a first portion extending from the inner end of the spiral wrap to a transition portion T, and a second portion comprising stepped portion 12 and extending from transition portion T to the outer end of spiral wrap 8. As shown in particular in FIG. 3, the second portion has a height hi greater than the height h2 of the first portion.

The transition portion T is delimited by a semicircular convex surface.

Figure 5:
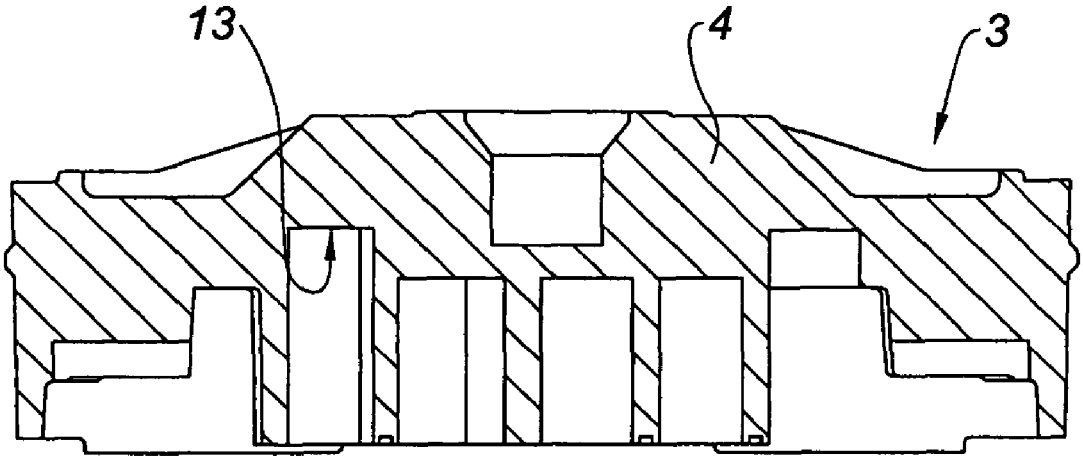
FIG. 5 is a lengthwise sectional view of the fixed scroll of the compressor in FIG. 1.

As shown in FIGS. 1 and 5, the fixed scroll 3 has a recess 13 provided on the face of the plate 4 facing the movable scroll 6 and designed to receive the stepped portion 12 of the spiral wrap 8 of movable scroll 6.

The recess 13 extends over about 360° and has a depth corresponding to the height of stepped portion 12, namely a height equal to the difference between the heights hi and h2 of the first and second portions of the spiral wrap 8.

The inner end of the recess 13 is delimited by a semicircular concave surface 4. The convex surface delimiting the transition portion T is designed to cooperate with the concave surface 14 delimiting the inner end of the recess 13.

Figure 6:
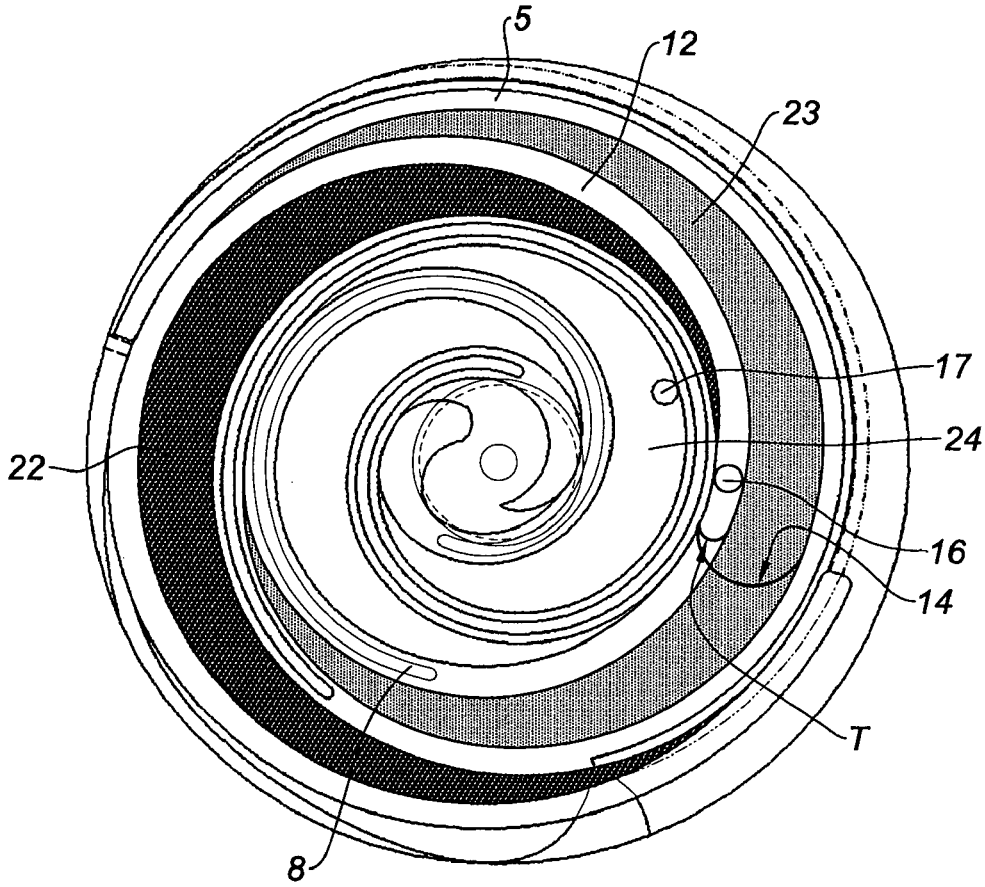
FIGS. 6, 8, 9, and 11 are cross-sectional views of the two spiral wraps of the scrolls in FIG. 1, in four distinct functional positions each offset by a quarter turn.
Figure 7:
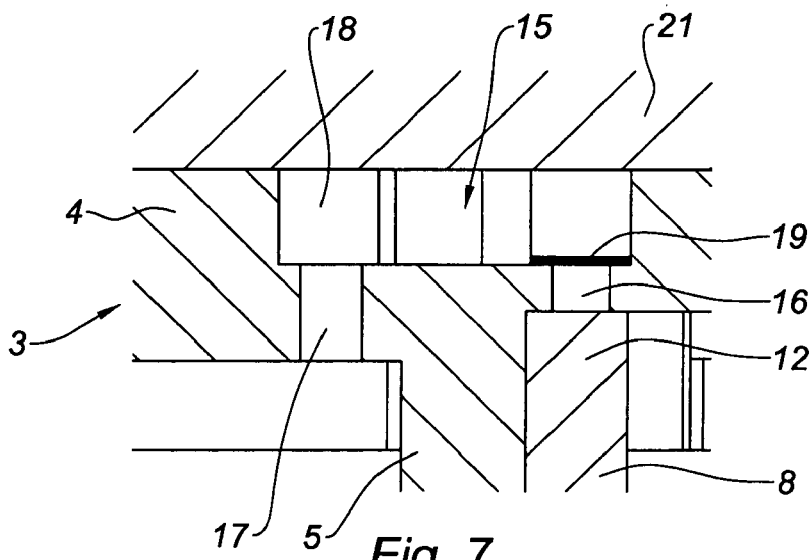
FIGS. 7 and 10 are partial views in lengthwise section of the two scrolls of FIG. 1, showing the check valve in two distinct operating positions.

As shown in particular in FIGS. 6 and 7, the fixed scroll 3 has a passage 15 in its plate 4. The ends of the passage 15 emerge on either side of the inner and outer walls respectively of spiral wrap 5 of the fixed scroll 3. The passage 15 is located opposite the inner wall of the second portion of the spiral wrap 8 that has stepped portion 12.

As shown in FIG. 7, the passage 15 has a first portion 16 terminating at the outer wall of the spiral wrap 5 of fixed scroll 3 and a second portion 17 terminating at the inner wall of the spiral wrap 5 of fixed scroll 3. The first and second portions 16, 17 extend parallel to the axis of the compressor and are connected to each other by a third portion 18 extending perpendicularly to the compressor axis.

As shown particularly in FIG. 6, the first and second portions 16, 17 of passage 15 are offset angularly from each other.

The upstream end of passage 15, namely the end of the first portion 16 terminating at the outer wall of spiral wrap 5, is located in the area of the inner end area of stepped portion 12, while the downstream end of passage 15, namely the end of the second portion 17 terminating at the inner wall of spiral wrap 5, is recessed from the upstream end of the latter relative to the concave surface 14.

As shown in FIG. 7, the passage 15 has a check valve 19 mounted in the third portion 18 and designed to allow fluid to flow only from the upstream end of passage 15 to the downstream end thereof.

The check valve is translationally movable between a first closed position (shown in FIG. 7) in which it comes up to the opening in the first portion 16 terminating in the third portion 18, and a second open position (shown in FIG. 10) in which it is remote from the opening in the first portion 16 terminating in third portion 18 and allows fluid to flow from the first portion 16 to the second portion 17.

The fixed scroll 3 has a cover 21 designed to sealably close off the third portion 18 of passage 15.

The operation of the scroll-type refrigeration compressor will now be described with reference to FIGS. 6 to 11.

FIG. 6 shows a position of fixed scroll 3 and movable scroll 6 wherein the two outer compression chambers 22, 23 delimited outwardly respectively by the inner wall of the spiral wrap 8 of movable scroll 6 and by the inner wall of the spiral wrap 5 of fixed scroll 3 each have a maximum surface area when viewed from above. This position of the fixed scroll 3 and movable scroll 6 corresponds to the admission position, i.e. the position in which gas is admitted into the compression chambers.

In this position of fixed scroll 3 and movable scroll 6, the compression chamber 23 delimited outwardly by the spiral wrap 5 of the fixed scroll 3 has a smaller volume than that of the compression chamber 22 delimited outwardly by the spiral wrap 8 of the movable scroll 6 because the latter is delimited essentially by the second portion of the movable spiral wrap having stepped portion 12 and by recess 13. As a result, there is dissymmetry of pressure between the two compression chambers 22, 23.

In this position of fixed scroll 3 and movable scroll 6, the convex surface delimiting the transition portion T is in contact with the concave surface 14 delimiting the inner end of recess 13. Hence, the two outer compression chambers 22, 23 cannot communicate with each other at transition portion T.

Likewise, when the fixed scroll 3 and movable scroll 6 are in the position shown in FIG. 6, the two outer compression chambers 22, 23 cannot communicate with each other at the passage 15 because the latter does not extend to compression chamber 22.

It should be noted that the inner compression chamber 24 has a higher pressure than that of the outer compression chamber 22. This pressure differential causes displacement of the check valve 19 into the position shown in FIG. 7, thus closing passage 15 and preventing the two compression chambers 23, 24 from communicating.

The presence of the check valve 19 in the passage 15 thus prevents the pressurized coolant gas from flowing from inner compression chamber 24 to outer compression chamber 23.

As soon as the movable scroll 6 moves from the position shown in FIG. 6, the convex surface delimiting the transition portion T moves away from the concave surface 14 delimiting the inner end of recess 13. Hence, the two outer compression chambers 22, 23 communicate with each other by the space E between the semicircular surfaces respectively delimiting the transition portion T and the inner end of recess 13.

This communication between the two compression chambers enables the pressures on either side of these chambers to be balanced and hence the pressure dissymmetry between these two compression chambers 22, 23 to be compensated.

It should be specified that the convex surface delimiting the transition portion T stays away from the concave surface 14 delimiting the inner end of recess 13 during one half turn of the movable scroll 6 starting from the position shown in FIG. 6.

Hence, the balancing of pressure on either side of compression chambers 22, 23 is ensured during one half turn of the movable scroll 6 from the position shown in FIG. 6 by means of space E provided between the semicircular surfaces that respectively delimit the transition portion T and the inner end of recess 13.

Figure 8:
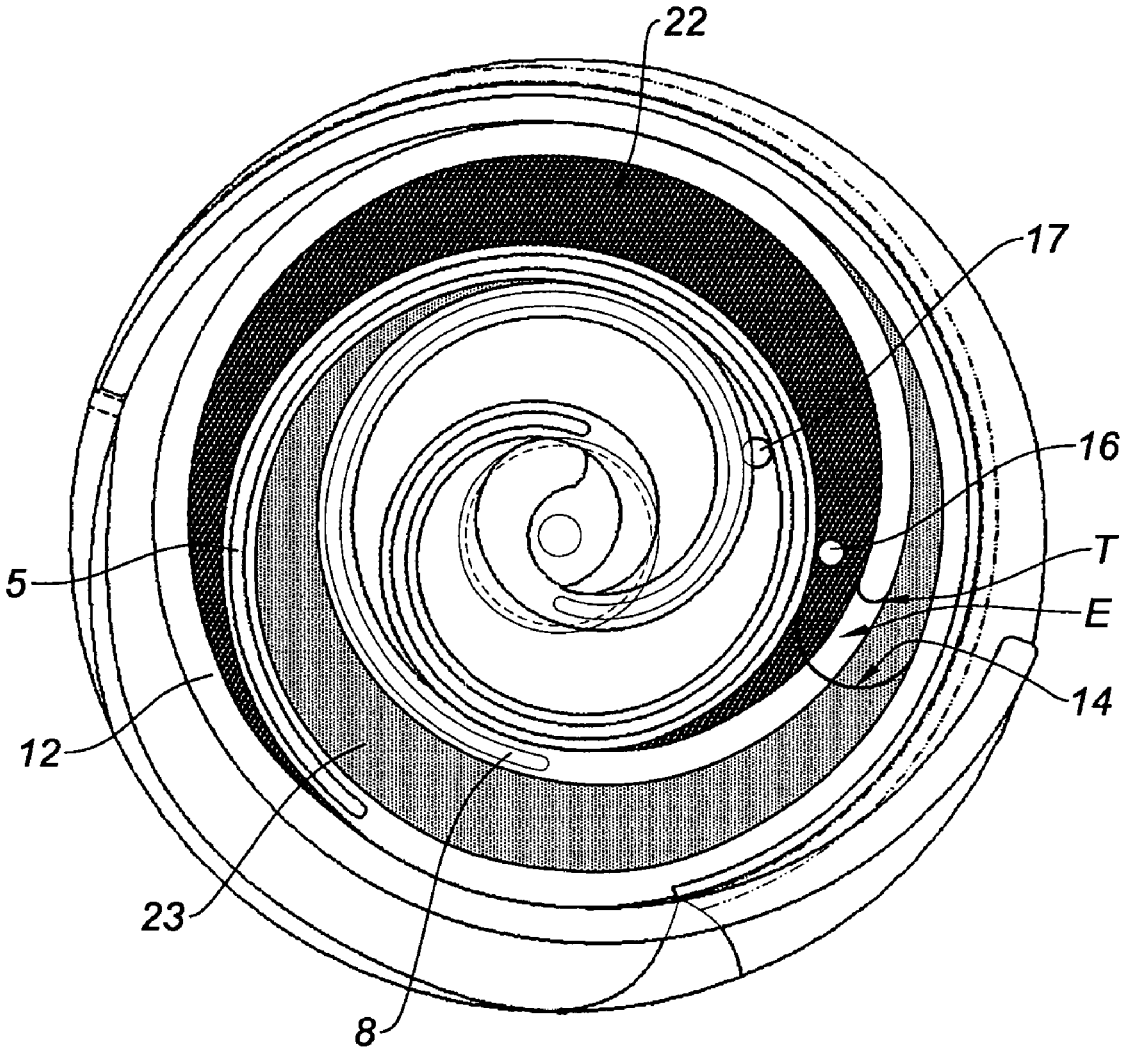

This space E is shown in particular in FIG. 8 which represents the positions of the fixed scroll and 3 and movable scroll 6 when the movable scroll 6 has executed a quarter turn from the position shown in FIG. 6.

It should be noted that the check valve 19 is held in the closed position shown in FIG. 7 during the first half turn of the movable scroll 6 from the position shown in FIG. 6.

Figure 9:
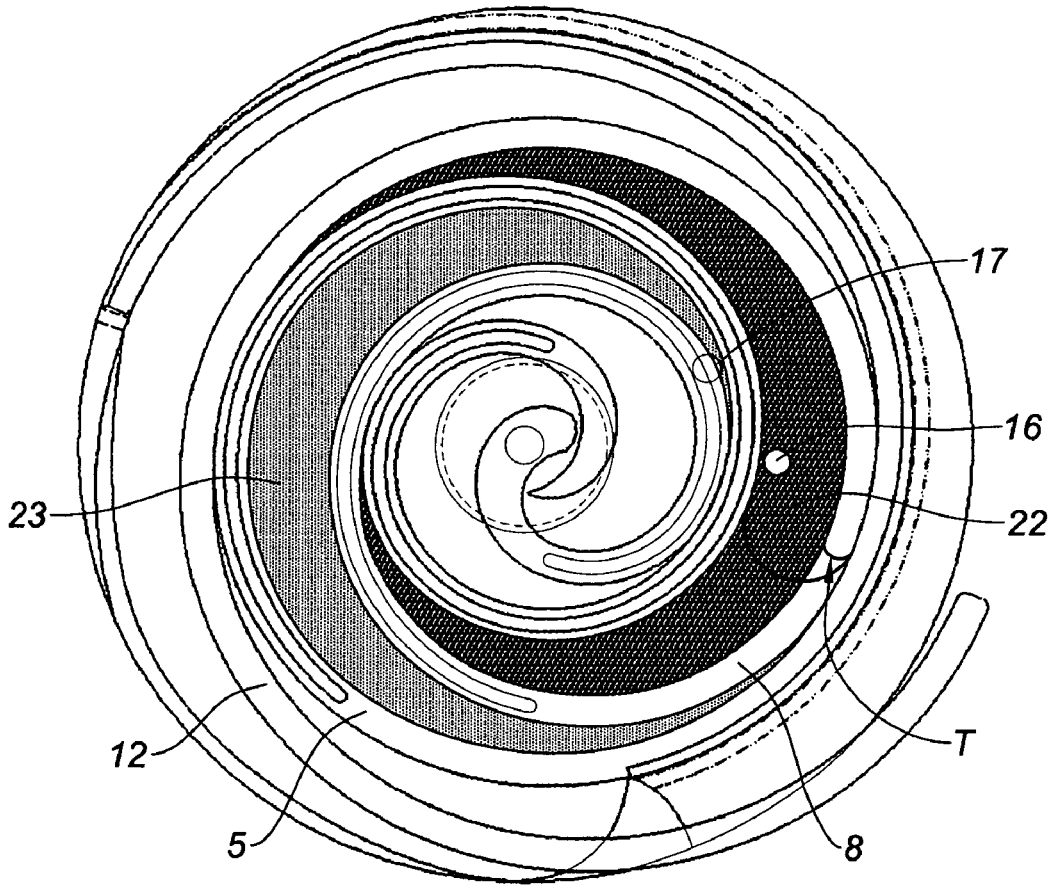

The fixed scroll 3 and movable scroll 6 are in the positions shown in FIG. 9 when the movable scroll 6 has executed a complete half turn from the position shown in FIG. 6.

In this position of the fixed scroll 3 and movable scroll 6, the convex surface delimiting the transition portion T is in contact with the concave surface 14 delimiting the inner end of the recess 13. Hence, the two compression chambers 22, 23 no longer communicate with each other at the transition portion T.

In this position of the fixed scroll 3 and movable scroll 6, the compression chamber 23 externally delimited by the spiral wrap 5 of the fixed scroll 3 has a smaller volume than that of the compression chamber 22 delimited externally by the spiral wrap 8 of the movable scroll 6 because the latter is partly delimited by the second portion of the spiral wrap 8 of the movable scroll 6 including the stepped portion 12 and by the recess 13.

Figure 10:
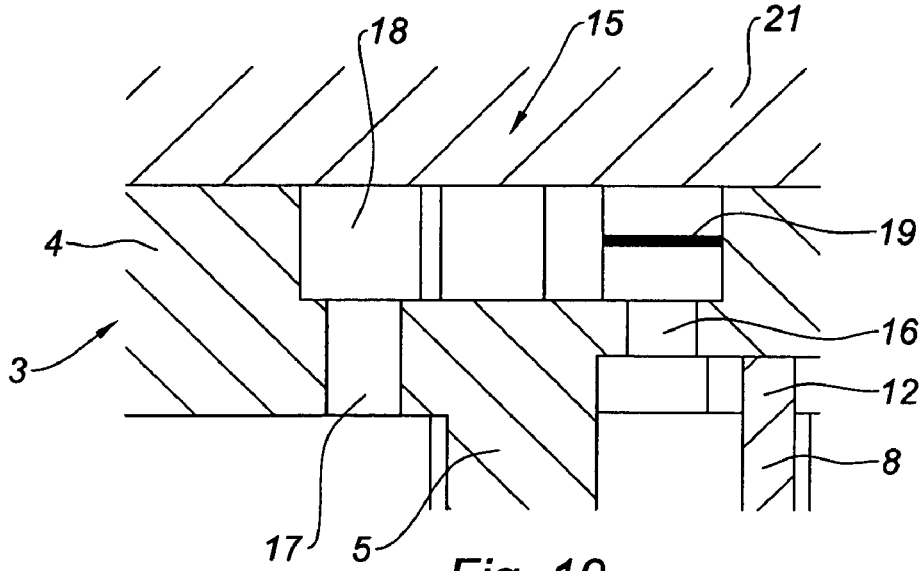

This pressure differential causes displacement of the check valve 19 into the open position shown in FIG. 10, thus causing the compression chambers 22, 23, to communicate via passage 15.

This communication between the compression chambers 22 and 23 allows the pressurized coolant gas to flow from the compression chamber 22 to the compression chamber 23, and hence the pressures to be equalized on either side of these chambers.

Figure 11:
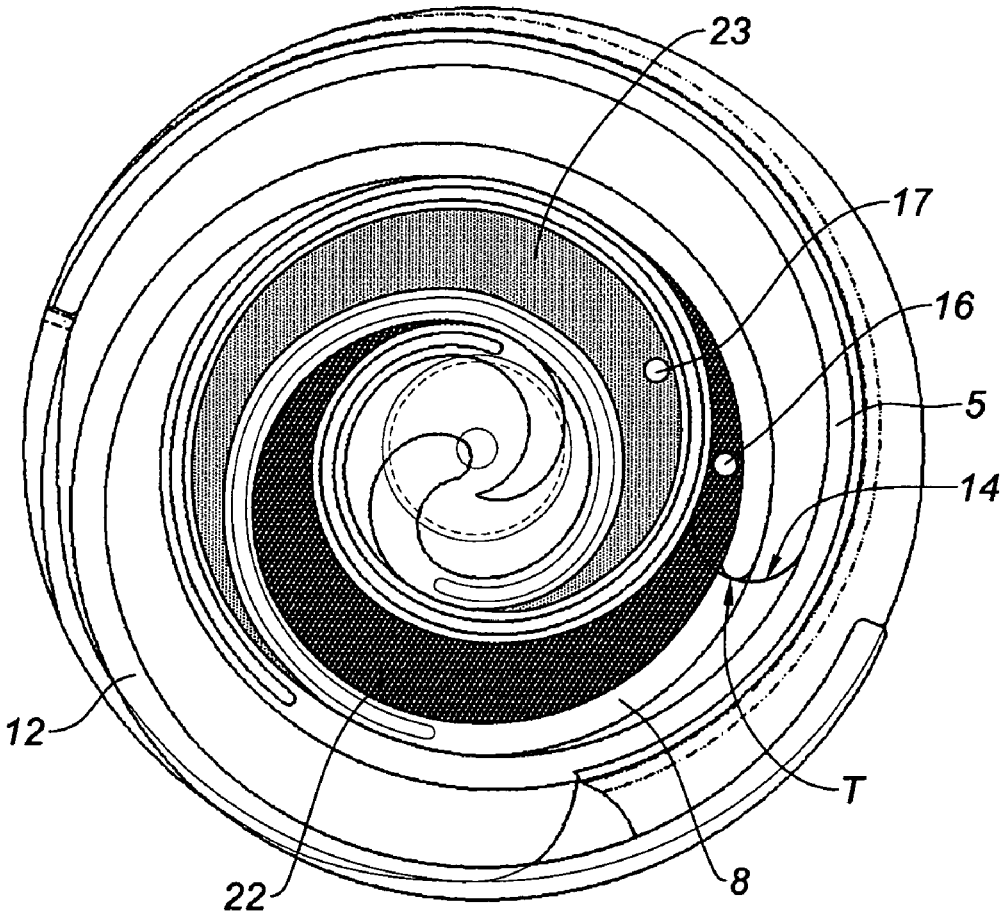

The fixed scroll 3 and movable scroll 6 are in the position shown in FIG. 11 when the movable scroll 6 has executed three-quarters of a turn from the position shown in FIG. 6. In this position of the movable scroll 6, the check valve 19 is still in the open position.

It should be specified that the passage 15 terminates in compression chambers 22, 23 respectively during half a turn of the movable scroll 6 from the position shown in FIG. 9.

Hence, the pressure balance on either side of compression chambers 22, 23 is ensured during half a turn of the movable scroll 6 from the position shown in FIG. 9 via passage 15.

Next, the movable scroll 6 returns to its position shown in FIG. 6 because the movable scroll has executed a whole turn.

Hence, the two compression chambers 22, 23 communicate essentially continuously with each other (except when they are in the gas admission position) ensuring compensation of the pressure dissymmetry of the chambers whatever the position of the movable scroll 6.

FIGS. 14 to 17 show a scroll-type refrigeration compressor according to a second embodiment of the invention which differs from that shown in FIGS. 1 to 11 essentially in that the passage 15' is provided in plate 7 of the movable scroll 6, and in that it is disposed facing the portion of the latter that has no step 12.

Figure 13:
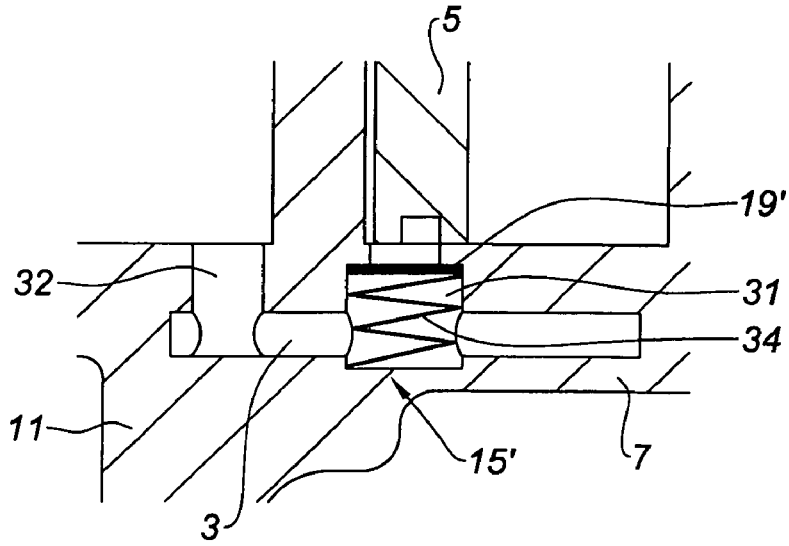
FIGS. 13 and 16 are partial views in lengthwise section of the two spiral wraps of the compressor of FIG. 12 showing the check valve in two distinct operating positions.
Figure 14:
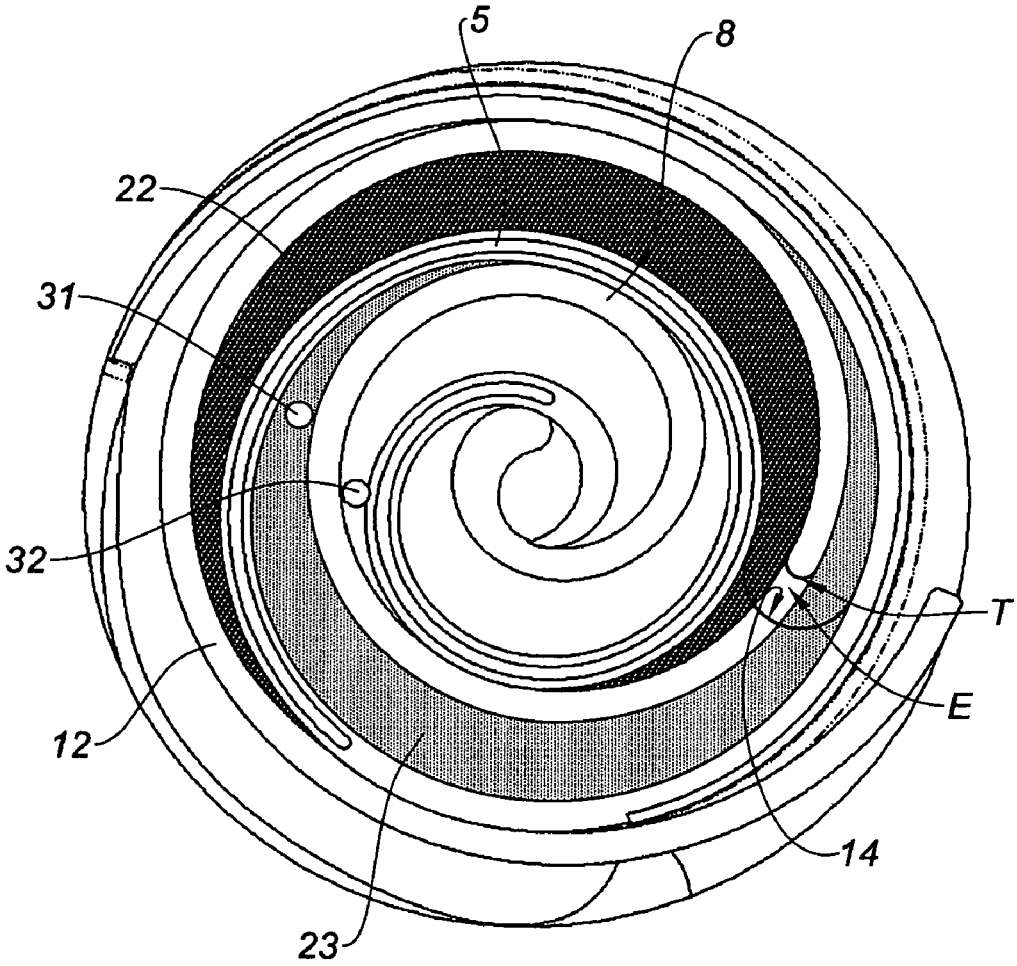
Figure 15:
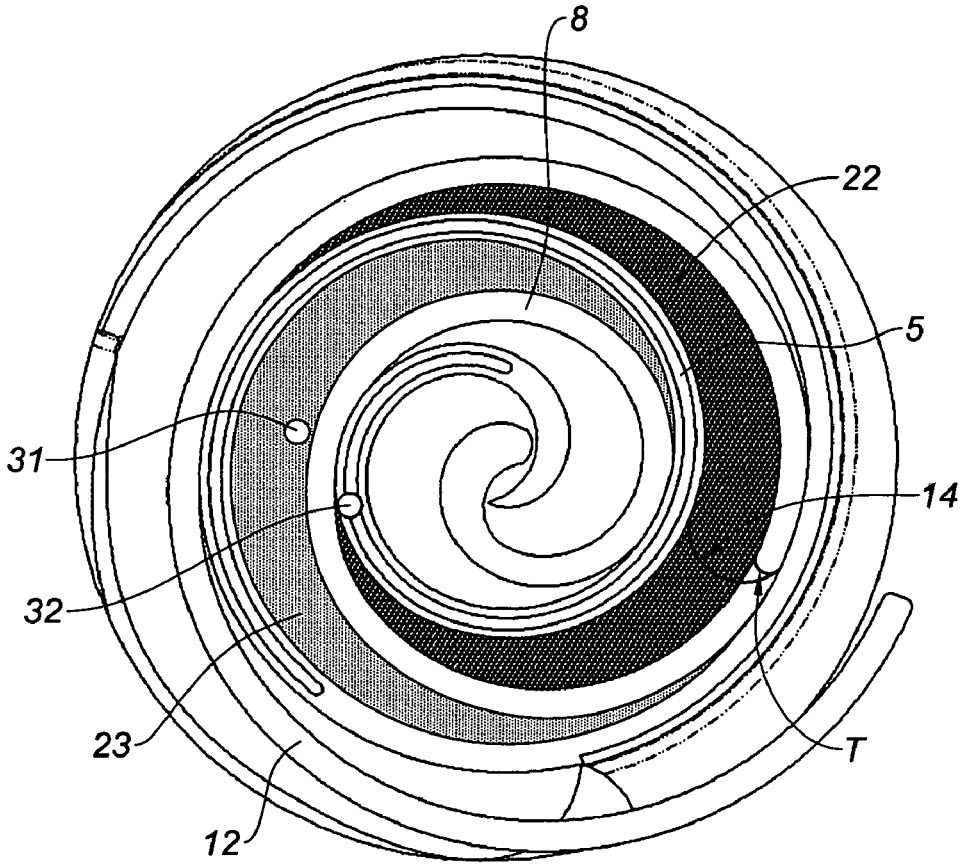
Figure 16:
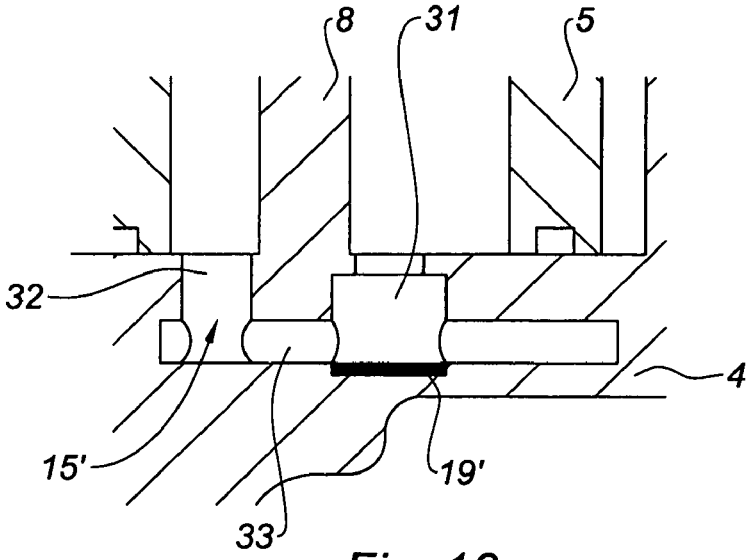
Figure 17:
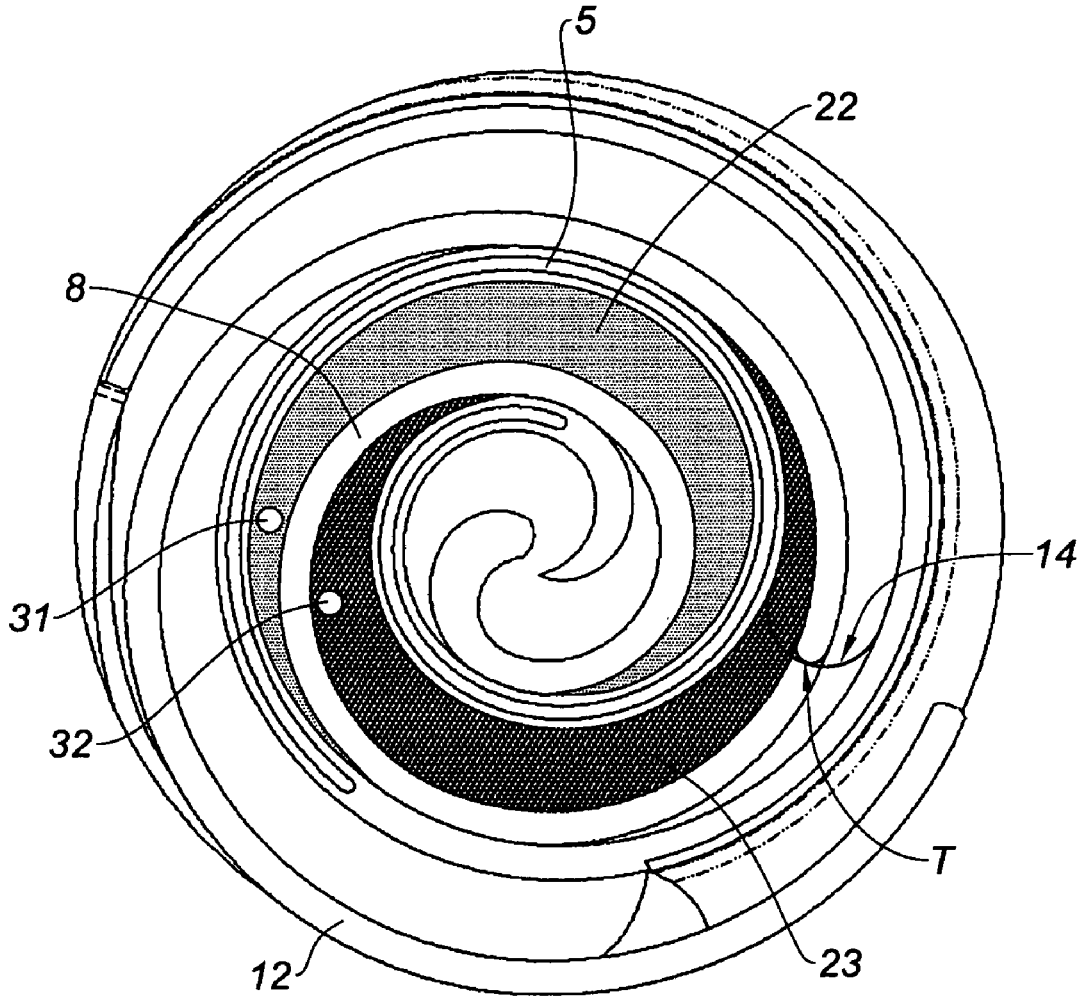

As shown in FIG. 13, the passage 15' has a first portion 31 terminating at the outer wall of the spiral wrap 8 of the movable scroll 6 and a second portion 32 terminating at the inner wall of the spiral wrap 8 of the movable scroll 6. The first and second portions 31, 32 extend parallel to the compressor axis and are connected to each other by a third portion 33 extending perpendicularly to the compressor axis.

Figure 12:
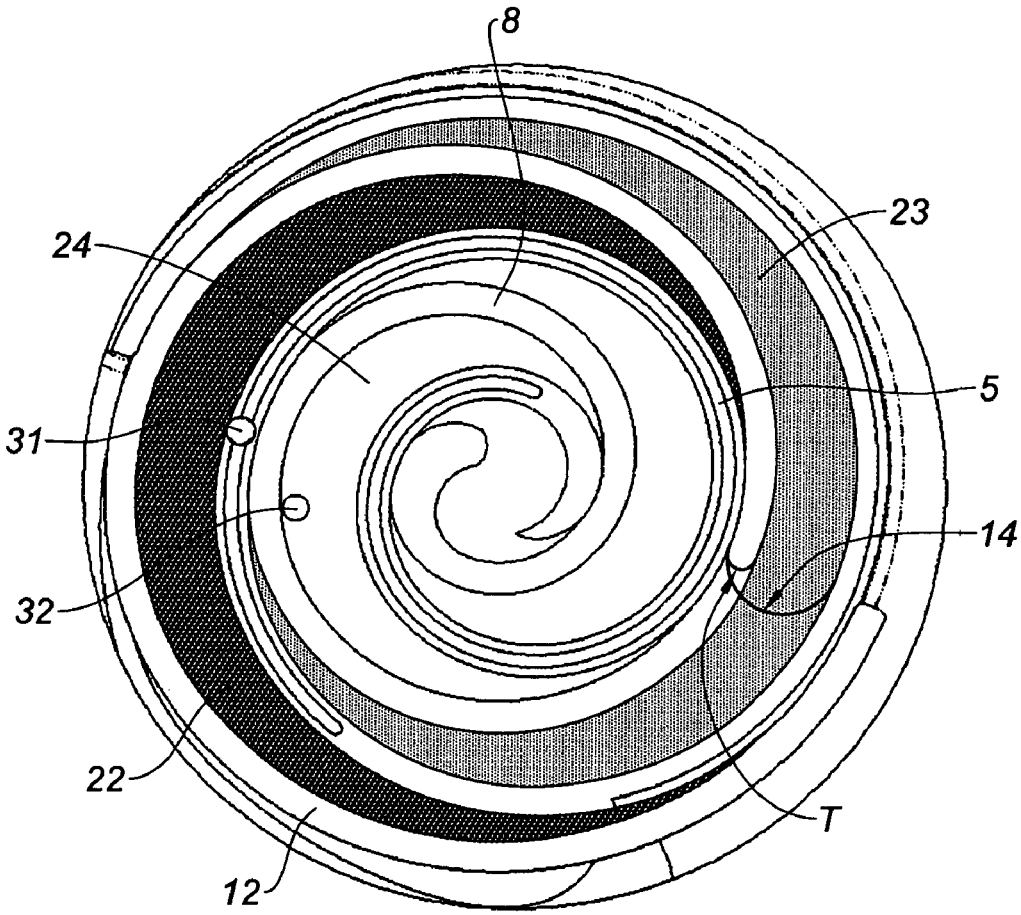
FIGS. 12, 14, 15, and 17 are cross-sectional views of two spiral wraps of a compressor according to a second embodiment of the invention, in four distinct functional positions each offset by a quarter turn.

As shown in particular in FIG. 12, the first and second portions 31, 32 of the passage 15' are offset angularly with respect to each other.

The upstream end of the passage 15', namely the end of the first portion 31 terminating at the outer wall of the spiral wrap 8 of the movable scroll 6, is essentially diametrically opposite the transition portion T while the downstream end of the passage 15', namely the end of the second portion 32 terminating at the inner wall of the spiral wrap 8, is recessed back from the upstream end of the passage relative to the inner end of the stepped portion 12.

The passage 15' provided in the movable scroll 6 has a check valve 19' mounted in the third portion arranged to allow fluid to flow only from the upstream end of the passage 15' to the downstream end thereof.

As shown in FIG. 13, the passage 15' has a check valve 19' mounted in the first portion 31 and designed to allow fluid to flow only from the upstream end of the passage 15' to the downstream end thereof.

The check valve 19' is translationally movable between a first position (shown in FIG. 13) in which it shuts off the first portion 31, and a second position (shown in FIG. 16) in which it allows fluid to flow from the first portion 31 to the second portion 32.

The check valve 19' is subjected to the action of a compression spring 34 that tends to keep the check valve in the closed position shown in FIG. 13.

The operation of the compressor according to the second embodiment of the invention is substantially identical to that of the compressor shown in FIGS. 1 to 11, and will hence not be described.

It goes without saying that the invention is not confined to the embodiments of this scroll-type refrigeration compressor described above as examples, but on the contrary embraces all alternative embodiments. Thus in particular, the fixed scroll 3 and movable scroll 6 could each have one or more passages each having a check valve. Moreover, each check valve used to control the flow in passages 15 and 115 could include an elastic element to facilitate its re-closure.

What is claimed is:

1. A scroll-type refrigeration compressor comprising:

a fixed scroll; and a movable scroll, whereby the movable scroll describes an orbital movement relative to the fixed scroll, the fixed and movable scrolls each being equipped with a spiral wrap, the two spiral wraps engaging each other and delimiting variable-volume compression chambers, only the spiral wrap of the movable scroll having a stepped portion extending over at least a portion of its length, wherein at least one of the scrolls has at least one passage designed to provide communication, during orbital movement of the movable scroll, between two compression chambers disposed symmetrically relative to the center of the orbital movement of the movable scroll, with the ends of the passage terminating on either side respectively of the outer and inner walls of the spiral wrap of the scroll with the passage or inside the outer and inner walls of the spiral wrap of the scroll with the passage, and wherein the passage has a check valve designed to allow fluid to flow only from the outer wall of the spiral wrap of the scroll with the passage to the inner wall thereof.

2. The compressor according to claim 1, wherein the ends of the passage are offset angularly from each other relative to the center of the orbital movement of the movable scroll by an angle less than or equal to 160°.

3. The compressor according to claim 1, wherein the fixed scroll has at least one passage disposed facing the portion of the spiral wrap of the movable scroll that has the stepped portion at an angular position relative to the center of the orbital movement of the movable scroll located between the angular position of the inner end of the stepped portion and a point diametrically opposite it.

4. The compressor according to claim 3, wherein the end of the passage terminating in or at the inner wall of the spiral wrap of the fixed scroll is recessed from the end of the passage terminating in or at the outer wall of the spiral wrap of the fixed scroll relative to the inner end of the stepped portion.

5. The compressor according to claim 1 wherein the stepped portion extends from the outer end of the spiral wrap of the movable scroll.

6. The compressor according to claim 5, wherein the stepped portion extends at least 180° from the outer end of the spiral wrap of the movable scroll.

7. The compressor according to claim 1, wherein the movable scroll has at least one passage disposed facing its portion that does not have the stepped portion at an angular position relative to the center of the orbital movement of the movable scroll located between the angular position of the inner end of the stepped portion and a point diametrically opposite it.

8. The compressor according to claim 7, wherein the end of the passage terminating in or at the inner wall of the spiral wrap of the movable scroll is recessed from the end of the passage terminating in or at the outer wall of the spiral wrap of the movable scroll relative to the inner end of the stepped portion.

9. The compressor according to claim 1, wherein the fixed scroll has a recess designed to receive the stepped portion of the spiral wrap of the movable scroll.

* * * * *